United States Patent [19]

Schutt et al.

[11] 4,082,039

[45] Apr. 4, 1978

[54] DUPLICATOR CONTROL BY AREA SCANNED CODED MASTER

[75] Inventors: Elmer F. Schutt, Parma; Bryce G. Thornton, Mentor; Charles R. Bentivegna, Jr., Mayfield Heights, all of Ohio

[73] Assignee: Addressograph Multigraph Corporation, Cleveland, Ohio

[21] Appl. No.: 618,362

[22] Filed: Oct. 1, 1975

Related U.S. Application Data

[63] Continuation of Ser. No. 412,347, Nov. 2, 1973, abandoned.

[51] Int. Cl.[2] ..... B41M 1/06

[52] U.S. Cl. ..... 101/450; 101/132.5; 101/142; 101/426; 250/557

[58] Field of Search ..... 101/130, 132, 132.5, 101/141, 142, 144, 145, 45, 90, 91, 96, 97, 226, 227, 113, 450, 426; 250/555, 557, 568, 570

[56] References Cited

U.S. PATENT DOCUMENTS

| | | | |
|---|---|---|---|
| 3,350,545 | 10/1967 | Street | 250/557 X |
| 3,553,437 | 1/1971 | Boothroyd | 250/557 X |
| 3,562,491 | 2/1971 | Branfield | 101/132 X |
| 3,650,204 | 3/1972 | Burger et al. | 101/132 X |
| 3,779,162 | 12/1973 | Ogawa et al. | 101/142 |
| 3,871,294 | 3/1975 | Kagari et al. | 101/132.5 |
| 3,898,928 | 8/1975 | Kancko | 101/132.5 |

FOREIGN PATENT DOCUMENTS

| | | | |
|---|---|---|---|
| 1,051,094 | 12/1966 | United Kingdom | 101/132 |

*Primary Examiner*—Ronald E. Suter
*Attorney, Agent, or Firm*—Russell L. Root

[57] ABSTRACT

There is disclosed an improvement in a system for sensing information encoded on a duplicating original, using the information to control copy processing. A duplicating original is installed onto the surface of a cylinder revolving in the duplication process. The encoded information, in the form of indicia printed on the original, is sensed by an optical read head arranged to scan the revolving cylinder. Signals indicating the position of the revolving cylinder are used to determine when to scan for information. Finally, the information sensed, e.g., the copy quantity, is used to control the processes of the duplicating machine. The manner in which the encoded information is arranged conforms to the writing capabilities of a computer output printer, which is preferably also used to prepare the body of text material being duplicated, and the read head is arranged to sense the thus applied indicia and reproduce the information accurately, allowing wide latitude for correct placement of the information. Hand encoding by an operator is also easily performed.

6 Claims, 7 Drawing Figures

DUPLICATOR CONTROL BY AREA SCANNED CODED MASTER

This application is a continuation of application Ser. No. 412,347 filed Nov. 2, 1973 now abandoned.

BACKGROUND OF THE INVENTION

In any duplicating system, programming the duplicator to process the desired quantity of copies has presented some problems. The processing herein referred to may take the form of either producing copies or distributing copies within a printing system. This becomes a problem in systems work when numerous short run originals with different copy counts are desired to be handled. Originally, an operator was required to set the quantity for each original into the machine every minute or two between successive printing cycles. A more desirable arrangement is when the information concerning the quantities for each original or the like is set into the duplicating machine automatically, thus freeing the operator for other work.

In one prior art concept, such automatic control of the duplicating machine is accomplished by reading coded information from an original document or prepared master, before insertion into the copying cycle of a duplicating device. This is done by either moving a read head across the stationary original or moving the original past a stationary read head as the duplicating cycle is entered. U.S. Pat. No. 3,650,204 uses this concept to read quantity information by moving a read head across a stationary original.

As a practical matter, these methods required a certain degree of preprinting on the original so that registration of the information is effective. This preparing may include timing marks or other devices to indicate the areas where information will be found, and thus aid in synchronization of the machine.

There has been increased demand for the ability to program duplicating processes from information contained on an original requiring less preprocessing than formerly available. Such an original would be, for example, the result of the output from a line printer connected to a computer. Another important source of such an original is an ordinary original with the information being hand encoded. In the past, either of these possibilities would have proved rather impractical due to the difficulty of assuring proper registration of coded information applied by these means.

The registration problem may also be complicated by the desirability of elimination gating, i.e., turning on the sensing logic only when information should be within its view. Such gating is desirable so that the chance for interpreting extraneous marks on the original as encoded information will be greatly reduced. There is, moreover, a necessity for field gating which is used to classify the mark signals according to some reference significance (e.g., numerical value). The computer generated originals, to some extent, and hand encoded originals, to a much larger extent, are susceptible to somewhat random placing of the information, and, if the information should appear outside the appropriate areas as defined by such field gating or elimination gating, an incorrect instruction (such as a wrong copy count) will occur.

The effectiveness of the invention to be described depends upon the particular type of duplicating machine used. A machine in which the original is fed to, accurately positioned on, and clamped to a regularly timed moving mechanical element, particularly a machine in which there is a timed cylinder onto which the original is inserted with its lead edge at a predetermined peripheral position on the cylinder, which cylinder is revolved in the duplicating process, is exemplary. A "Multilith" Model 2750 duplicator manufactured by Addressograph-Multigraph Corporation is an example of such well-known machines.

SUMMARY OF THE INVENTION

The present invention relates to the machine reading of coded information for an original to be duplicated, and, more particularly, to the control of a duplicating system from the information read from the coded original while in process.

A primary object of this invention is to simplify registration of the information so that computer generated and even hand encoded originals may be read efficiently, even though not placed with a high degree of precision.

The foregoing object is achieved by (1) a special coding arrangement involving the progressive summing of signals generated by sensing marks placed somewhat randomly withing specificed areas on the original, and by (2) controlling the sensing of marks in response to means for signalling cylinder position, individually or more especially in combination.

A further object of the invention involves the accentuation of code marks on the original when it takes the form of a lithographic master so as to improve the reliability with which they may be read.

The foregoing object is achieved by causing the original, after it has been placed on the cylinder, to be rotated through an inking cycle before the read head is activated.

DETAILED DESCRIPTION OF THE PREFERRED EMBODIMENT

Figure 1:
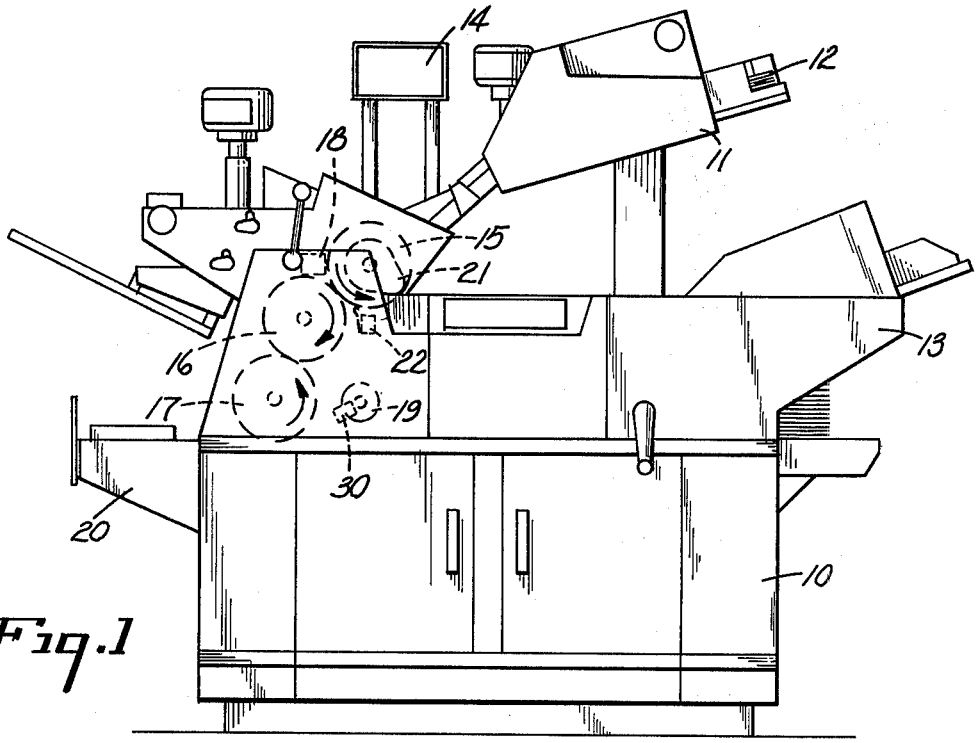
FIG. 1 is a side elevation of a duplicating machine in which the control system described is used.

In a duplicating machine as shown in FIG. 1, a basic frame 10 is present upon which is mounted a mechanism 11 for feeding duplicating originals, duplicating originals 12 being shown in the hopper of the feed mechanism. Also included is a mechanism 13 for feeding copy sheets. An electromechanical counter 14 which ordinarily directs the duplicator when to stop producing copies is shown. The duplicating machine has a master cylinder 15, blanket cylinder 16, and impression cylinder 17. A copy collector 20, to catch completed copies, is included. All of the elements considered so far are conventional parts of the duplicating system and, by themselves, do not constitute part of the present invention.

Since the duplicating machine used in the embodiment described in detail is a rotary offset printing machine, the duplicating original 12 will be a lithographic master. It should be appreciated, however, that the duplicating original may be of various sorts and, so far as the present invention is concerned, its nature is limited only by the necessity of being accurately mountable onto a timed moving machine part such as a revolving cylinder during the reproduction cycle.

Also in the present embodiment, although the quantity of copies to be reproduced is the primary concern, the invention should be understood to be adaptable to various types of processing of copy sheets. Thus, for example, the distribution of various numbers of the copies into separate receivers may be controlled by the information to be read from the duplicating original 12.

When operating the duplicator of the prior art, an operator is required to place an original 12 in the hopper of the original feed mechanism 11 and set the desired copy quantity on the switches of the electromechanical counter 14. Once the machine is started by pressing the appropriate switch, operation is automatic until the desired quantity is produced. At this time, the electromechanical counter 14 directs the machine to shut off.

Figure 7:
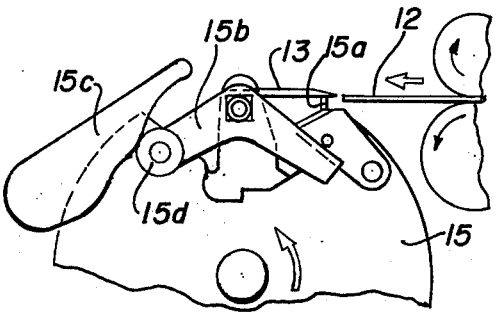
FIG. 7 is a partial elevation, drawn to a larger scale, of the master cylinder of the machine of FIG. 1, and associated parts, showing especially the operation of the sheet clamping gripper.

After the duplicating machine has been started, the original 12 is fed into the machine by the duplicating original feed mechanism 11 in a well known manner. For example, it is customary for each original to be automatically fed into a clamp on the duplicating cylinder surface so as to have its leading edge precisely located on the cylinder by the clamp. This construction is shown in FIG. 7 wherein the lead edge of an original 12 is shown about to enter the open clamp 13 on the periphery of the cylinder 15. The original feed forces the lead edge of the original firmly against stops 15*a* so that the original is accurately registered to a point on the periphery of the cylinder, and the clamp is momentarily operated to open position by the lever 15*b* coacting with a cam 15*c*. The clamp 13 and lever 15*b* are drivingly connected, and the lever operates the clamp in opposition to a closing spring (not shown). As is customary, the cam 15*c* occupies a predetermined radial position about the axis of the cylinder 15 so as to properly time the clamp's opening and closing operation. The cam is, of course, mechanically pivotable or bodily shiftable to a position out of the path of a follower 15*d* on the lever 15*b* so as to leave the clamp in closed position except when master clamping is required. The operation includes installing a plurality of duplicating originals onto the surface of a revolving cylinder in sequence, with each in the same circumferential orientation upon the surface, and holding each original while copies are made. At the time each original is installed, it is treated and inked so that an inked image of the original is transferred to the blanket cylinder 16 when the cylinders rotate. The copy sheet feed mechanism 13 is then directed to feed copy sheets between the blanket cylinder 16 and the impression cylinder 17 in the conventional way. This causes an inked image of the original to be transferred to the face of each of the copy sheets as they pass between the two cylinders. The completed copies fall into the copy collector 20, where they are stacked. When the electromechanical counter 14 indicates that the last desired copy has been processed, the copy sheet feeder is directed to stop feeding sheets. The original is then automatically ejected from the master cylinder 15 and both the blanket and master cylinder are cleaned. If another original is present in the hopper of the duplicating original feed mechanism 11, the original will be automatically fed into the machine and the operations will repeat. At this time, the number of copies desired from the original must be set on the counter. However, if there is not another original present, the machine will continue in an idling mode awaiting operator attention.

The foregoing description relates to conventional machines in current use so that the structure has not been shown in detail.

The additions to the duplicating system which are particular to the present invention, are also illustrated in part in FIG. 1. Adjacent to the master cylinder is a read head 18. The particular elements added to obtain synchronization are a timing disc 19, a cam operated switch 22, and a light source and photocell 30 to detect movement of the timing disc. Also added to the machine, although not shown in FIG. 1, is the electronic circuitry necessary to the invention, shown diagrammatically in FIG. 6.

The read head 18 is located adjacent to the master cylinder 15 in order that the information present on the duplicating original 12 mounted thereon may be read. The particular type of read head used is not considered to be part of the invention in its most general aspects. However, an optical reading device is presently contemplated and the detailed description will proceed on this basis.

A signal means indicating the circumferential position of the revolving cylinder for activating the read head when the encoded information should be within view is necessary. This signal means is established through the use of two separate devices added to the duplicating machine.

Figure 2:
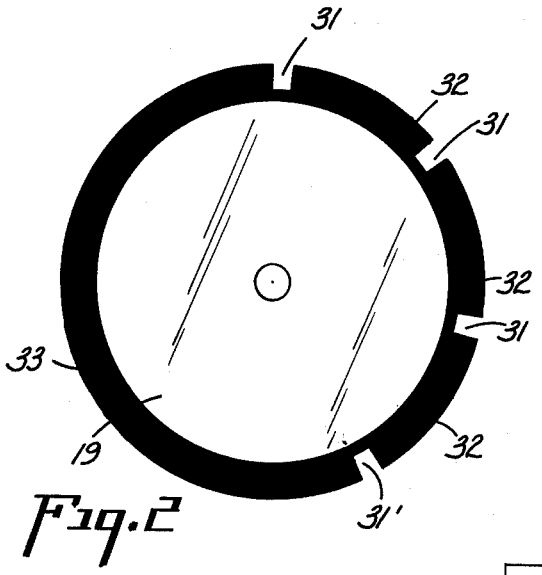
FIG. 2 is a face view of the timing disc used for synchronization.

The first of these devices is the timing disc 19 moving at a speed related in a predetermined manner to the speed of the revolving cylinder and an arrangement for producing signals relating to the position of this disc. The timing disc 19 is illustrated in FIG. 2. Alternating transparent areas 31, 31' and opaque areas 32 and 33 extend around the entire circumference of the disc. The timing disc is mounted on a shaft in the machine not shown in the figures. The position of the shaft is not critical as it is an existing part of the duplicating machine. The only consideration of this shaft of importance to the present invention is that the movememt of the shaft is suitably and directly related to that of the master cylinder preferably making one revolution for each revolution of the printing cylinders.

When the light source and photocell 30 are placed on either side of the disc 19 as the master cylinder turns, output signals consisting of a train of pulses result. Each of the pulses relates to a circumferential position on the revolving cylinder.

In the operation of the system, the geometry of the machine and the duplicating original are such that the latter is automatically inserted onto the master cylinder with some predefined index point (such as point A in FIG. 4) always very close to the same circumferential position on the cylinder as explained in connection with FIG. 7 hereinabove. A cam device 21 revolving in concert with the master cylinder, with an orientation relating to the position of a duplicating original on the cylinder, is shown cooperating with the index cam switch 22, the second of the two added devices abovementioned. The name is derived from the function of the switch, which is to indicate that an index point (such as point A near the beginning edge of the duplicating original 12) is substantially in alignment with the read head 18.

The combination of the index cam switch 22 and train of pulses from the timing disc 19 are used to determine when to accept signals from the read head 18. The signals from the read head are, in turn, used to determine when the desired number of copies have been produced and then to terminate the operation of the duplicating machine.

Figure 3:
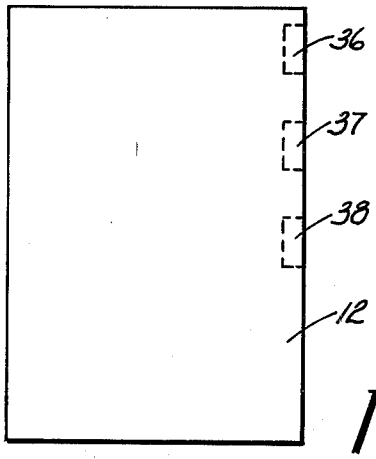
FIG. 3 is a face view of the duplicating original used in the invention.

An example of the encoded duplicating original 12 to be used in the system is illustrated in FIG. 3. The information indicating the number of copies to be processed is contained in the information margin of the original which is shown on the right side when the original is face up with the lead edge at the top. The quantity information is broken into three groups, and consists of marks (not shown) to be placed on the original in three designated areas identified by numerals 36, 37 and 38. These three groups represent the decimal digits of the quantity, the hundreds designation being placed in area 36, the tens in area 37 and the units in area 38. Each of the data groups contains the same number of similar marks as the value of the digit required. As an example, the quantity 705 would be represented as seven in series marks in the hundreds group, in area 36, none in the tens group, in area 37, and five marks in series in the units group, in area 38. In this embodiment, either a printed "I" or a "1" can be used as the mark, or a hand engrossed bar can be used, if desired.

One of the advantages of this invention is the fact that the reading equipment provided permits placement of the information which is not extremely critical. However, there is a specific tolerance for placement of the information in the information margin, lengthwise thereof, of plus or minus one-half inch. The width of the strip of encoded information has a predetermined limit. As a practical example, a width of ½ inch might well be adopted. With marks of, say, ⅛ inch in length, this would provide a latitude of perhaps plus or minus 3/16 inch in location transversely of the margin. No marks other than the encoded information should appear in the entire information margin. The lines which appear in FIG. 3 (shown dashed) are there only for the purpose of indicating where the information is to be placed and need not actually appear on the master. The encoded information is desired to be placed in, for example, one-inch long bands spaced at one-inch intervals along the information margin of the original. Considering the plus or minus one-half inch tolerance applied to each of the areas for the encoded information in the information margin, the actual areas which may be permitted to contain the encoded information appear as shown by the dot-dash lines in FIG. 4, which is an illustration to a larger scale of a duplicating original 12, like that in FIG. 3. These permissable acceptance areas are designated 36', 37' and 38'. The first area, 36', commences ½ inch from the lead edge of the master to provide an ample clamping margin, and its lead end, identified as A, is considered an index or starting reference for purposes of the following discussion. The first area, 36', contains the hundreds information while the second area, 37', contains the tens information and the third area, 38', contains the units information.

The main reason for placing the encoded information along the long margin of the duplicating original is to allow for computer generation of the originals. No special considerations are necessary to produce the duplicating original on a computer line printer, since the normal output of a line printer has a print line parallel to the long axis of the original and can thus make appropriate transverse marks (for example, I or 1) in this area. If it is desired that the coded information on the margin not appear on the copies, this result can be readily achieved by using a duplicating original wider than the copies desired, locating the coded information in this extra marginal space, and adjusting the copy sheet guides laterally so as to eliminate the printing of the code.

Figure 4:
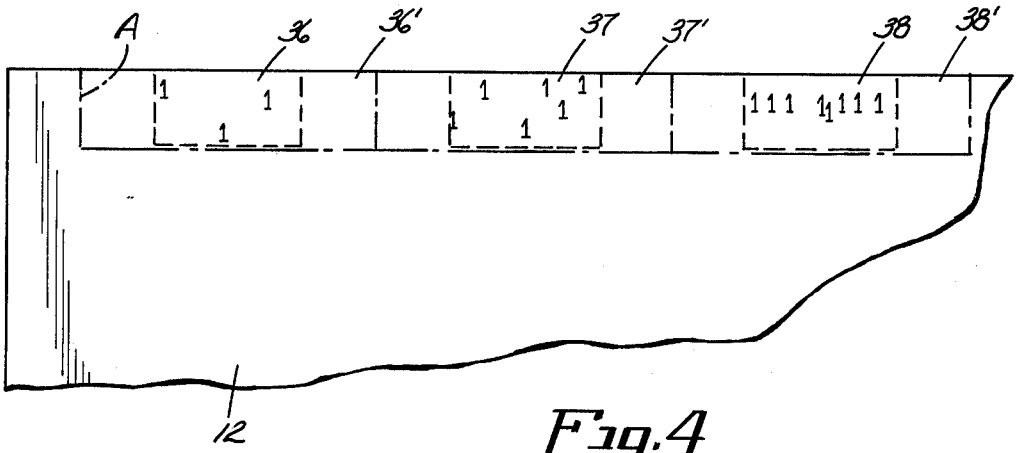
FIG. 4 is a face view of a portion of a coded duplicating original.

In FIG. 4 the lead edge of the original 12 is at the left of the figure while the information margin is at the top. The encoded information is represented by the groups appearing on areas 36, 37 and 38. Although only three groups are shown, it should be appreciated that the coded information may extend further along the information margin of the original, and may be categorized for various distinct control functions, as desired.

The information shown encoded on an original 12 in FIG. 4 has the hundreds, tens and units information encoded entirely within one-inch areas 36, 37 and 38, respectively. Although this is the desired format of the information to appear on the original 12, the plus or minus one-half inch tolerance provided by areas 36', 37' and 38' respectively actually results in a 2-inch area for each of the groups of encoded information, should portions of the information be inaccurately placed. As previously noted, the first ½ inch of the information margin starting for the lead edge of the original must be left blank to insure adequate room for clamping the master. The information to be encoded in the hundreds area, 36, may actually appear anywhere within the next two inches in this case, which area is outlined in dot-dash lines and designated area 36' . Likewise, for the tens information area, 37, and the units information area, 38, the information may actually extend for two inches in the areas indicated 37' and 38', respectively. Preferably, of course, the marks will be placed within the areas 36, 37 and 38 in order to enhance reliability of the reading operation.

The marks representing information to be encoded may be placed anywhere within the information margin with respect to the upper or lower bounderies of the margin as shown in FIG. 4, and still be sensed by the read head 18. The placement of the information marks relative to one another as shown in FIG. 4 requires only that there exists a discernable space between adjacent marks (measured lengthwise of the margin).

If the marks were to be manually placed by an operator, this would normally be accomplished by placing a template along the margin provided with three one-inch gaps corresponding to the areas 36, 37 and 38, and with a mark or edge matching the lead edge of the original.

In FIG. 4, the information group in area 36 represents the "hundreds" information. In this particular case there are three marks present, therefore indicating the number of "hundreds" to be three. Next, the group in area 37 represents the "tens" information. Thus, six marks indicate six "tens". Finally, the last group in this case represents the number of "units". Therefore, there are eight "units" in this case. As an example, if the encoded information was intended to represent the quantity of copies to be made, the information indicated in FIG. 4 would result in three hundred, sixty-eight copies being reproduced.

Figure 5:
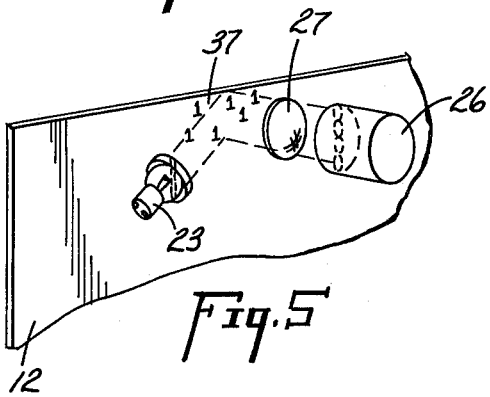
FIG. 5 is a diagramatic illustration of an optical read head sensing a coded original.

FIG. 5 illustrates in more detail encoded section 37 of the original 12 along with a diagramatic illustration of an optical read head used to sense information. The read head 18 includes a light source 23 and photocells with appropriate mounting 26. The read head 18 is so arranged that the light from light source 23 is reflected from the original 12 and focused by a lens 27 onto the photocells 26 and thus generates signals corresponding to marks or no marks. In an exemplary embodiment of this invention, four photocells are used in the optical read head and are arranged in a line, spanning the width of the information band, as shown in FIG. 5 such that regardless of where an encoded mark is positioned across the information margin of the original 12, at least one of the photocells has the ability to detect the mark. Suitable arrangements are made so that if more than one photocell detects a mark, only one signal results, e.g., by connecting their outputs through an OR gate.

Figure 6:
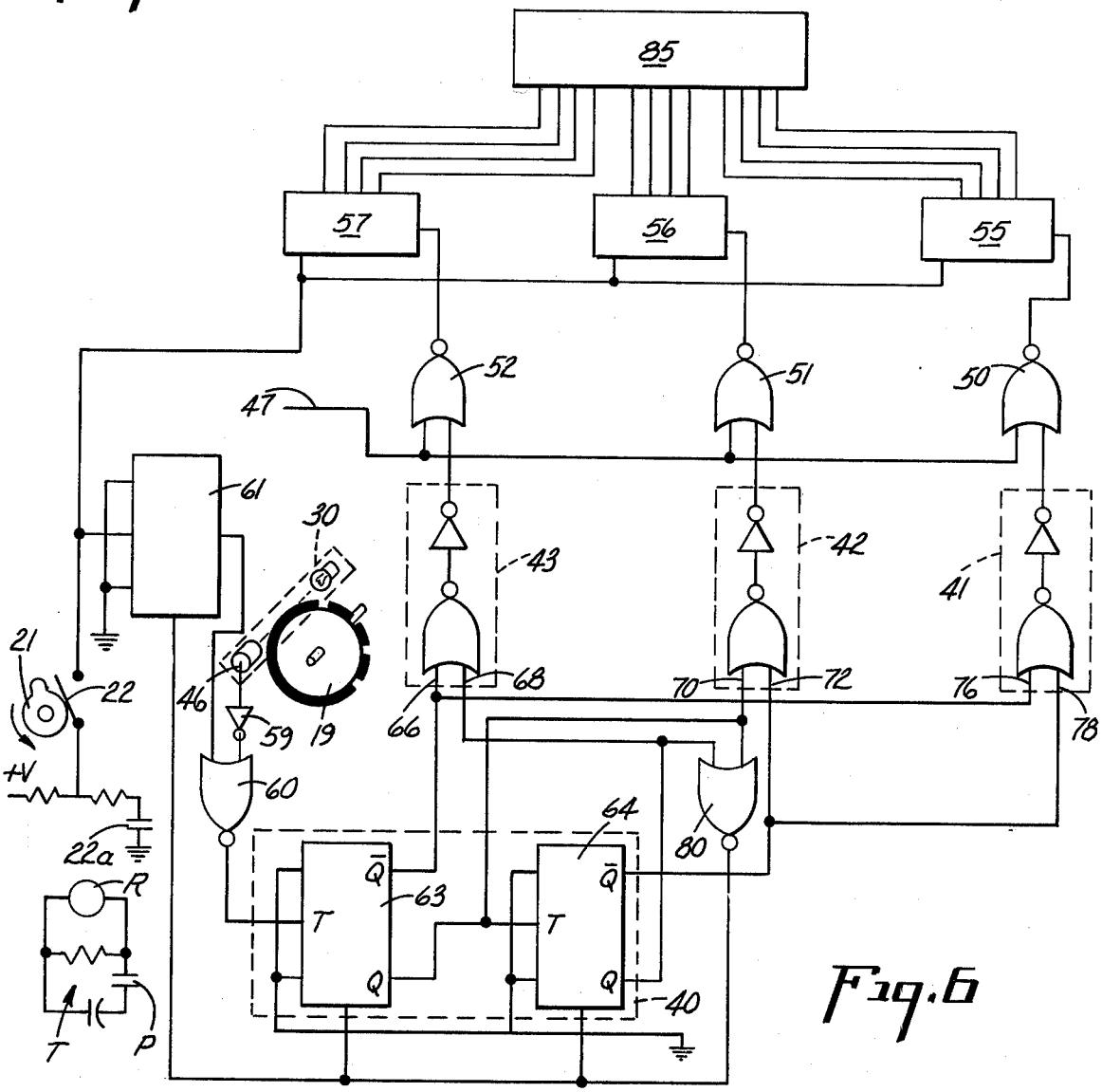
FIG. 6 is a logic diagram of the circuitry involved in the invention.

A control system using the index cam signal, timing disc signals, and read head signals for terminating the copy processing only after the quantity indicated by encoded information on a duplicating original has been processed, is illustrated in FIG. 6. The outputs of a bistable counting circuit 40 are gated through the use of counter gating circuits 41, 42 and 43. As a result, signals are provided indicating the beginning of the areas of the presence of each group, successively. These signals, when applied to the read head enabling gate circuits 50, 51 or 52, allow the passage of a signal on conductor 47 corresponding to signals from the read head 18. Depending upon whether the units, tens or hundreds group is being read, the outputs of gate circuits 50, 51 and 52 are fed to the inputs of binary decade up counters 55, 56 or 57, respectively.

These up counters are devices for progressively summing the signals fed to them and registering a total of such signals.

Transparent areas 31 on the timing disc 19 provide pulses which correspond to the beginning of each of the encoded information areas 36', 37'or 38' and opaque areas 32 correspond to the duration of areas 36', 37' or 38'. That is, in this preferred embodiment the first transparent area 31 on the timing disc 19 corresponds to index point A on the information margin and the next three transparent areas (31, 31 and 31') on the timing disc 19 correspond to points two, four and six inches, respectively, from point A. Therefore, the light and photocell arrangement 30 results in a train of pulses being produced when the timing disc 19 rotates, the pulse due to each area 31 corresponding to the beginning of an area to be read, and the pulse resulting from 31' providing a reset function as will presently appear. The train of pulses appearing on sensor lead 46 is fed to an invertor 59 which corrects the polarity of the signal in order that the train of pulses may be passed through NOR gate 60, when enabled.

The index cam switch 22 is actuated whenever cam 21, attached to the cylinder, indicates that the predetermined index point A would be about to come under the read head 18. Since reading is only desired whenever the original is fully installed, inked and ready to run, another switch 22*a* is also provided which is closed, by a relay coil R, energized in a known manner only after all automatic preparation cycles of the duplicator have been completed (indicated by contact P in FIG. 6), and which is automatically de-energized by a precharged RC timing circuit T which maintains energization for a period of a fraction of a machine cycle, long enough for cam 21 and switch 22 to complete their pulse. When switches 22 and 22*a* are both closed, a timing signal is fed to the input of "flip-flop" 61. In this manner, once the index cam switch 22 detects the presence of index point A at read position, the output signal from "flip-flop" 61 enables the NOR gate 60 in order that the train of pulses corresponding to the transparent areas on timing disc 19 may pass to the bistable counter 40.

Before any pulses are received from NOR gate 60, flip-flops 63 and 64 of the bistable counter 40 are in an off position and thus have a logical HI signal on the upper outputs and a logical LO signal on the lower outputs. In this manner, none of the gating circuits 41, 42 or 43 are enabled, and, therefore, the read head signals on lead 47, if any, do not pass to the counters 55, 56 and 57. When the first transparent area 31 on timing disc 19 is sensed by the photocell and light arrangement 30, NOR gate 60 causes a pulse to be transmitted to flip-flop 63 of the bistable counter 40. Since the flip-flops used in this embodiment trigger on a negative going pulse, this pulse causes the flip-flop 63 to change state and thus produces a logic HI signal at the lower output of the flip-flop 63. This changing of state of the flip-flop 63 causes a logical LO signal to be present on lead 66 and, since flip-flop 64 was not toggled, there is also a LO on lead 68 whereby NOR gate 52 is enabled. At this point, signals from the read head 18 on lead 47 are accepted by the hundreds up counter 57. Thus, the encoded information corresponding to the hundreds area 36 is entered into the up counter 57. This process continues until the next transparent area 31 on timing disc 19 is read by photocell and light arrangement 30. When this area is read and the resulting pulse is directed to flip-flop 63 by NOR gate 60, the flip-flop 63 again changes state. At this time, when the lower output of flip-flop 63 returns to a logical LO signal, flip-flop 64 also receives a pulse and thus is caused to change state so that its upper output has a logical LO signal. These occurrances cause logical LO signals to apear at leads 70 and 72 of gating circuit 42. In this way, the gate 51 is enabled so that read head signals on lead 47 pass to up counter 56 and thus enter the tens information from area 37 of the original. Likewise, when the next transparent area on timing disc 19 is sensed, bistable counter 40 is again pulsed, causing the flip-flop 63 to change state so that a LO signal appears at its upper output. The signal at the upper output of flip-flop 64 will remain LO, whereby LO signals will be provided on both leads 76 and 78 and gate 50 is enabled allowing the units counter 55 to accept information.

When the next transparent area 31' is sensed by the photocell and light 30, generating a pulse which again changes the state of the flip-flop 63, a LO state appears at the lower output of this flip-flop, generating a pulse which also changes the state of flip-flop 64. A LO state therefore appears at both lower outputs. Accordingly, none of the circuits 41–43 generate an enabling signal for the corresponding gates 50–52, and any further information (which would be represented by spurious marks in the margin) will not be passed to any of the decade up counters 55–57.

From the foregoing description it is apparent that the logic circuit illustrated in FIG. 6 constitutes an interpretation means coordinating signals from the read head or sensing means 18 and the cylinder position signals so as to interpret the significance of the marks on the margin of the original.

The condition of the bistable counter 40 when transparent area 31' has been read, as above-described, is the beginning or reset condition for the counter. Therefore, the outputs of flip-flops 63 and 64 at this point in time will be used as a basis for resetting the remainder of the circuit illustrated in FIG. 6. When both of the lower outputs present a logical LO signal, NOR gate 80 will produce a signal which is connected to the reset terminals of flip-flops 61, 63 and 64. The binary decade up counters 55, 56 and 57 are preferably reset immediately prior to reading the duplicating original 12 by the signal produced by the closing of the index cam switch 22.

In the event that other duplicating processes were intended to be controlled by the information, in addition to the quantity, the groups of information would be extended along the entire information margin of the original. The gating for this additional information would be controlled by extending the bistable counter 40 and the counter gating to provide additional serially active output sites, and adding appropriate decade up counters for triggering the particular function or process.

After one complete duplicator cycle, when all of the coded information has been read, the outputs of binary decade up counters 55, 56 and 57 in the form of three binary coded decimal numbers are then entered into binary coded, decimal down counter device 85. The transfer may be effected in any of various ways, for example, by employing a suitable machine cycle signal such as that which initiates feeding of copy paper and applying this signal to the down counter 85 via its conventional existing gates (not shown) associated with its count presetting input connections to transfer the signal voltages on all conductors to the down counter stages in parallel. The counting device 85 may be any one of a number of devices well known in the art. This counting device 85 is caused to count down from the binary coded number originally entered by the movement of copy paper sheets through the duplicator, in the case of this preferred embodiment. When the counting device 85 has reduced the preset binary number to zero, a signal is generated and the operations of the duplicator are controlled thereby in a known manner to either accept a further duplicating original 12 or cycle through to shut down the machine to idle condition. The counting device 85 can be reset by manual operation of the reset control on counter 85 in the event the operator desires to abort the printing run or produce a number of copies less than the coded number.

Before any copies are processed, but after the duplicating original 12 has been installed on the master cylinder and its preparation completed, the index cam switch 22 responsive to the cam device 21 and operating in timed relationship with the cylinder 15, closes a circuit which enables the reading operation, and the quantity information is read. The timing disc 19, index cam switch 22 and the bistable counting circuit represented as 40 in FIG. 6 determine where the encoded information is to be found. As the master cylinder rotates and moves the duplicating original past the read head 18, the encoded information is recognized by the read head and stored in the down counter 85.

The signals from lead 47 in FIG. 6 gated into the decade up counters 55, 56 and 57, represent a single pulse for each mark present as encoded information. When the processing of a quantity of copies indicated by the encoded information is completed, the counting device 85 generates a signal which, in a known manner, directs an end to the delivery of copy sheets. After the original is removed and the blanket cyclinder cleaned, the next duplicating original is inserted onto the master cylinder and the reading of information and processing continues as before. In the case of no remaining duplicating originals 12, the duplicating machine cycles to an idle condition automatically in a known manner.

It should be noted also that the signals gathered by the up counters 55, 56 and 57 can be passed to any alternate signal storage device upon appropriate signal and there put to use for controlling any suitable function of the duplicator or its attachments.

From the foregoing description it can be seen that the present invention provides an extremely effective automated control for duplicating equipment such that a series of duplicating originals, whose copies require different treatment in one way or another, can be processed rapidly even though the individual duplicating runs are very short as required by office systems procedures, mainly because the procedure can be effected with minimum operator intervention.

Particularly notable is the capability of the system for accepting coding of numbers of copies to be printed, the number to be distributed to a location, or the number to be otherwise processed, which coding is of a very simple and straightforward character in which a digit is represented by a plurality of marks or strokes, placed sequentially, and equal in number to the value of the digit. With this arrangement the coding system is readily remembered and requires minimal thought and translation on the part of the operator, thus contributing to accurate engrossment if manually done, and to ready checking whether written by hand or by a computer output printer. Accuracy is also enhanced when the code marks are printed out by a computer, since the simple coding system lends itself to programming of less than average complexity.

A second feature is the remarkable lack of restriction on mark placement. Since the marks need not be precisely located, no preprinting of the originals (as with clock tracks or other mark location identifiers) is required. The number of marks present is the only determinant. Their spacing and alignment in the present system are without any degree of significance comparable to that required in most mark reading arrangements. Location of the marks, generally within a particular area, is, of course, required to assure that they will be read. Wide latitude as to where they may be placed is, however, a feature of the system, so that accuracy is assured with less than average care on the part of the party manually marking the original or programming the computer, and with less than average reliability required of the product of the line printer.

Placing of the coding along the long margin of the duplicator original with the marks running transversely of the margin, enables the coding to be placed by the same computer output line printer which is printing the text to be duplicated, and to be printed during the same operation by which the text is printed. It also provides for ready reading of the marks in a serial fashion by a single read head placed adjacent the duplicator cylinder on which the original is placed. Since the nature of the duplicator mechanism is such that the original is placed on the cylinder in a location of relative precision, the original, without any specific additional hardware, is under close mechanical control, and this results in an accurate reading system of unusual mechanical simplicity.

A further unique feature of the invention is to be found in the arrangement, especially applicable to lithographic duplicating, which times the reading of the code marks to occur after the original has been prepared for printing by the application of ink and moisture. When thus controlled, the information marks which have been placed on the information margin of the original, however faint or variable in intensity they may have appeared originally, will pick up sufficient ink from the ink system of the duplicator to make them more nearly uniform and enhance their contrast with the background, and thereby assure a highly reliable reading by the read head.

What is claimed is:

1. A duplicating machine for providing copies of an original comprising:

a rotatable cylinder;

clamping means on said cylinder for attaching an original thereto with its lead edge in substantially a predetermined peripheral location;

said rotatable cylinder supporting said original, the latter having a plurality of groups of numerical identification data, each group in the form of separate marks arrayed on the original so as to be disposed generally along a path running peripherally of the cylinder when the original is in place thereon, each group being positioned in an area of predetermined linear extent occupying a predetermined relationship with respect to the lead edge of the original, whereby each area is so positioned on the original as to result in its location in a predetermined circumferential position with respect to said cylinder when the original is installed thereon, and the data in each area being indicative of a different order digit of a multi-digit decimal system number;

a reading station including optical sensing means disposed adjacent said cylinder, for sensing each group of data in turn during rotation of said cylinder with the original thereon and for providing data signals corresponding to the data in each group of data;

cylinder position indicator means independent of any data on said original for providing a plurality of cylinder position signals each indicative of a cylinder position relative to the sensing means corresponding with the readiness to begin sensing one of the groups of data in one of said areas on the original on the cylinder, summing means comprising a plurality of register means each of which is connectable with said optical sensing means designated for progressively summing the data signals emanating therefrom for storing data representative of the value of the order digit indicated by the data in the said one of said groups and for signalling the total of the thus summed data signals; and switching means connected with said optical sensing means and said cylinder position indicator means for switching the flow of data read by said sensing means from one register means associated with one digit of the multi-digit number to another register means associated with another digit of the multi-digit number in response to a position signal from said cylinder position indicator means.

2. A duplicating machine for providing copies of an original comprising:

a rotatable cylinder supporting the original having at least one group of numerical identification data in the form of separate marks arrayed on the original so as to be disposed generally along a path running peripherally of the cylinder when the original is in place thereon;

a reading station including sensing means disposed adjacent said cylinder, for sensing each mark in turn during rotation of said cylinder with the original thereon and for providing unit value data signals, one for each mark sensed;

summing means comprising register means connected with said sensing means for progressively summing the unit value data signals emanating therefrom, for expressing the total number of such unit value data signals received from said sensing means according to a number system having a base greater than one, and for storing the thus expressed total in signal form; and means responsive to the signals stored by said summing means for controlling a function of the duplicating machine.

3. The method of duplicating copies of an original using a duplicating machine which comprises:

preparing coded information on the face of the original, said information comprising a group of spaced marks arranged in a line generally parallel to one edge of the original but without regard to uniformity of spacing between marks, said marks, solely by virtue of the number of marks present, being representative of a predetermined decimal system value;

sensing the marks in series by relatively moving said original and a read head in a direction generally parallel to the line of marks;

electrically progressively summing the sensed marks and interpreting their total as a decimal system numerical value, and generating a signal indicative of said value; and in response to said signal controlling the operation of said duplicating machine from said original in accordance with said value.

4. The method of duplicating as set forth in claim 3, wherein the line of marks placed on the original includes a plurality of individual groups, each group representative of a distinct decimal digit of a plural digit decimal system number, and wherein the step of summing comprises separately progressively summing and interpreting each group of marks and generating a signal representative of the decimal digit value based on the total number of marks in the group, thereafter interpreting the composite decimal system number and generating signals indicative of its composite value.

5. The method of duplicating which includes:

introducing text information into a computer associated with an output printer in such manner that the text information will appear as a body of text in parallel lines in the central portion of a printout sheet to be used as an original for duplicating;

introducing into the computer, coded information relative to the operation of a duplicator in such manner that the coded information will appear on a margin of the printout sheet as a line of marks parallel to the lines of text material in the body of text;

operating the computer to cause printing of said text information and said coded information on a printout sheet to thereby produce an original;

placing said original on the cylinder of a rotary duplicator with the line of coded information extending peripherally thereof;

sensing the marks in said line of coded information by means of a stationary read head as the cylinder is rotated and generating unit value data signals each corresponding to one of said marks electrically progressively summing said unit value data signals, expressing the total number of such unit value data signals according to a number system having a base greater than one, and storing the thus expressed total in electrical signal form;

operating the duplicator to print copies; and controlling the operation of the duplicator in accordance with thus stored signal.

6. The method of rotary lithographic duplicating on a duplicating machine having a cylinder which includes:

encoding copy processing information on the face of an original to be used for duplicating;

inserting the encoded original on the cylinder of the lithographic duplicating machine;

treating said original in preparation for printing by applying ink to the face thereof as the cylinder rotates;

thereafter photoelectrically sensing the encoded information on said original as the cylinder is rotated, and generating signals corresponding to said information; and controlling operation of the duplicator in accordance with the sensed copy processing information, whereby the encoded copy processing information is treated in preparation for duplication along with the original to thereby enhance the readability of the information during the sensing thereof.

* * * * *